US006109072A

United States Patent [19]

Jung

[11] Patent Number: 6,109,072

[45] Date of Patent: Aug. 29, 2000

[54] CLOTHES WASHER HAVING ROTATIONAL FORCE CONVERSION APPARATUS

[75] Inventor: Young-Jun Jung, Seoul, Rep. of Korea

[73] Assignee: Daewoo Electronics Co., Ltd., Seoul, Rep. of Korea

[21] Appl. No.: 09/220,331

[22] Filed: Dec. 24, 1998

[30] Foreign Application Priority Data

Jun. 30, 1998 [KR] Rep. of Korea ..... 98-11590
Jun. 30, 1998 [KR] Rep. of Korea ..... 98-11612

[51] Int. Cl.[7] ..... D06F 17/00

[52] U.S. Cl. ..... 68/53; 68/184

[58] Field of Search ..... 68/53, 131, 133, 68/134, 184

[56] References Cited

U.S. PATENT DOCUMENTS 5,142,887 9/1992 Priem et al. ..... 68/18 FA
5,722,265 3/1998 Cho ..... 68/133
5,746,071 5/1998 Youn ..... 68/53

FOREIGN PATENT DOCUMENTS 2308603A 7/1997 United Kingdom .

*Primary Examiner*—Philip R. Coe
*Attorney, Agent, or Firm*—Jacobson, Price, Holman & Stern, PLLC

[57] ABSTRACT

In a clothes washer having a rotational force conversion apparatus, the rotational force conversion apparatus comprises a disk cam formed on a driving shaft, a plurality of followers contacted with the disk cam and each having a coil spring which enables the follower to be in constant contact with the disk cam.

4 Claims, 6 Drawing Sheets

CLOTHES WASHER HAVING ROTATIONAL FORCE CONVERSION APPARATUS

BACKGROUND OF THE INVENTION

1. Field of the Invention

The present invention relates to a clothes washer having a rotational force conversion apparatus, and more particularly to a clothes washer having a rotational force conversion apparatus in which a plurality of followers contact with a rotating disk cam, thereby reciprocating each piston connecting with each corresponding follower.

2. Description of the Prior Art

Generally, a clothes washing machine is utilized to automatically perform a series of washing, rinsing, and dehydrating processes, in which clothes, water, and a predetermined amount of detergent are put into a washing tub, and swirling water strikes clothes.

FIGS. 5 and 6 illustrate the typical clothes washer in which a water supply valve 12 is provided at the top rear portion of a housing 10, and a water basket 20 is placed in the housing 10. A shower ring 22 is formed at an upper portion of the housing 10, into which water is supplied from the water supply valve 12. A washing tub 30 is provided in the water basket 20, and is comprised of a cylindrical base 32, and a cylindrical body 34 placed on the base 32. Inlet opening 32*a* are formed at an inner portion of the base 32 opposite to each other, and the body 34 is comprised of a plurality of panels 34*a*, each panel having plural penetrated openings 34*b*, through which water passes back and forth between the washing tub 30 and the water basket 20. A balancer 36 is provided at the top portion of the body 34, and an outlet opening 36*a* is formed at the lower portion of an inner circle of the balancer 36 in a similar arrangement as the inlet opening 32*a*.

Each guide filter 40 is provided on an inner surface of the body 34 opposite to each other. The guide filter 40 has a water passage 40*a* which channelize the inlet opening 32*a* of the base 32 and the outlet opening 36*a* of the balancer 36. A filter unit 42 is provided at an exit of the outlet opening 36*a*. A pulsator 60 is rotatably assembled at a center of the base 32, which is rotated by a gear mechanism 52 receiving a driving force of a motor 50. A plurality of water spouting openings 62 are formed along a periphery of the pulsator 60, plural blades 64 are formed at a lower surface of the pulsator 60, and a bubble generator 70 is installed at a lower portion of the water basket 20.

In a washing machine having the above configuration, when the washing mode is selected by a user, the pulsator 60 is rotated by an operation of the gear mechanism 52, of which a driving force is supplied from the motor 50. A cyclone water flow occurs in the washing tub 30 owing to the rotation of the pulsator 60, and the water flow in the pulsator 60 is discharged through the spout opening 62 above the pulsator 60, thereby enabling the water flow to spout. Bubbles generated by the bubble generator 70 are further supplied during the above occurrence, thereby continuing the washing mode. Furthermore, the water in the washing tub 30 is supplied toward the inlet opening 32*a* by the rotation of the pulsator 60, and reaches the outlet opening 36*a* through the water passage 40*a*. The water drops into the washing tub 30 through the outlet opening 36*a*, thus producing the shower water flow.

In a conventional clothes washer, rotation of a pulsator and bubble are utilized in the washing mode, and water pumped to a top or a middle portion of the washing tub strikes clothes in the washing tub. However, since swirling water caused by the rotation of the pulsator, bubbles, and aquatic bursts occurs only at the top portion or the middle portion of the clothes, little washing force is applied to the lower portion or the side portion of the clothes. This causes inefficient washing in respect of all the clothes.

SUMMARY OF THE INVENTION

Therefore, it is an object of the present invention to provide a clothes washer having a rotational force conversion apparatus for improving the washing efficiency of the washer.

It is another object of the present invention to provide a clothes washer having a rotational force conversion apparatus for sufficiently performing anti-twisting/tangling operation of clothes.

In order to achieve the above objects of the present invention, a clothes washer having a rotational force conversion apparatus comprises

BRIEF DESCRIPTION OF THE DRAWINGS

The above objects and other advantages of the present invention will be more clarified by describing a preferred embodiment thereof with reference to the accompanying drawings in which.

DESCRIPTION OF THE PREFERRED EMBODIMENT

Hereafter, the invention will be described in further detail with reference to the accompanying drawings.

Figure 1:
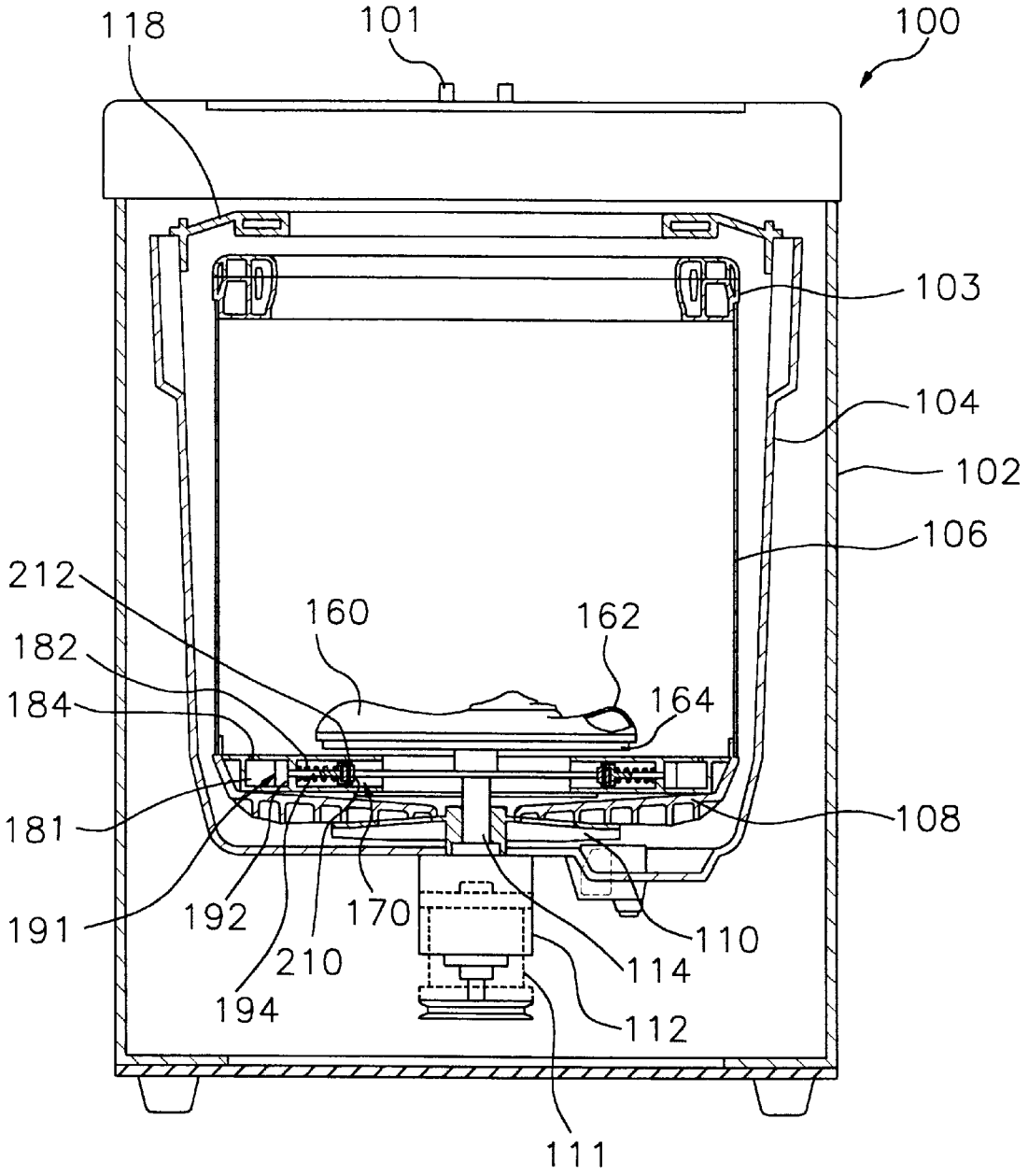
FIG. 1 is a vertical elevational view of a clothes washer having a rotational force conversion apparatus according to the present invention.
Figure 2:
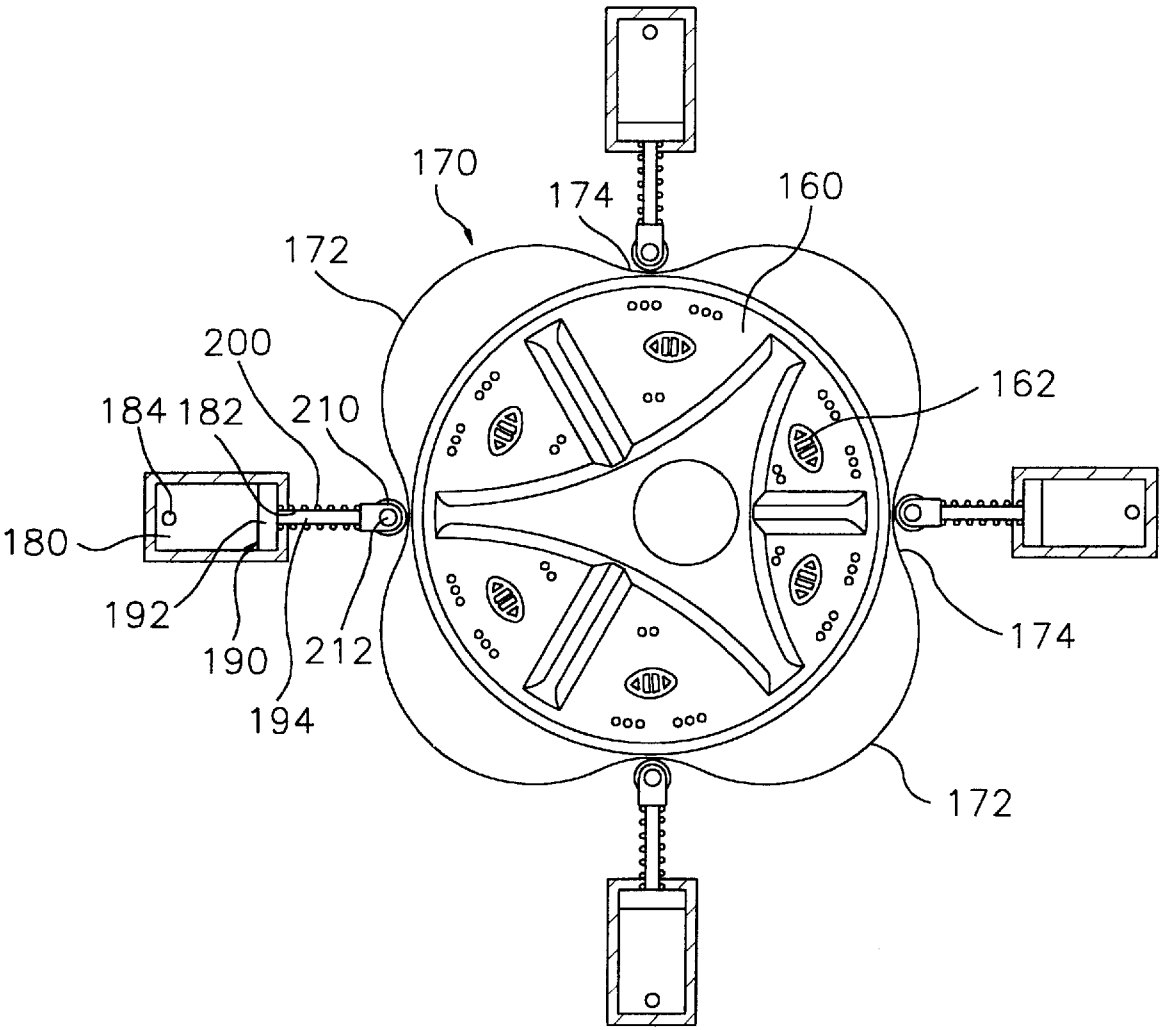
FIG. 2 is a plane view of the rotational force conversion apparatus shown in FIG. 1.

FIGS. 1 and 2 illustrate a clothes washer having a rotational force conversion apparatus. The clothes washer 100 is comprised of a housing 102, a water basket 104 provided in the housing 102 for containing water, and a washing tub 106 rotatably provided in the water basket 104. A base 108 is provided at the lower portion of the washing tub 106, and a flange 110 is integrally formed at the base 108. The flange 110 is detachably assembled with a driving shaft 114 of a gear mechanism 112 that is connected with a motor 111 (shown by dashed lines) for operating the clothes washer, and further a pulsator 160 is fixed to the driving shaft 114 to generate a water flow. A balancing ring 103 is assembled with a top of the washing tub 106 to balance the washing tub 106 during the rotation of the washing tub 106.

Specially, in the present embodiment of the invention, a rotational force conversion apparatus is further equipped that is connected with the gear mechanism 112 enabling high pressure water to strike the clothes.

As one component of the rotational force conversion apparatus, a cam 170 is provided under the pulsator 160 in a horizontal manner, and has a plurality of convex portions 172 and concave portions 174 having almost circular arc which are formed alternatively along a periphery of the cam 170. In the drawings, the convex portion 172 and the concave portion 174 provided total four, but the total number is unlimited.

A plurality of pumping chambers 180 are provided at a bottom of the washing tub 106 in a radial manner to the shaft 114. It is more preferable that a traversal cross section of the pumping chamber 180 has a circular shape. An opening 182 is horizontally formed at one end of the pumping chamber 180 proximal to the pulsator 160, and an opening 184 is vertically formed at another end of the pumping chamber 180. It is preferable that the opening 184 is maximally distanced from the opening 182. Four evenly arranged pumping chambers 180 are illustrated in the drawing, but the number of pumping chambers is changeable as required.

Figure 3:
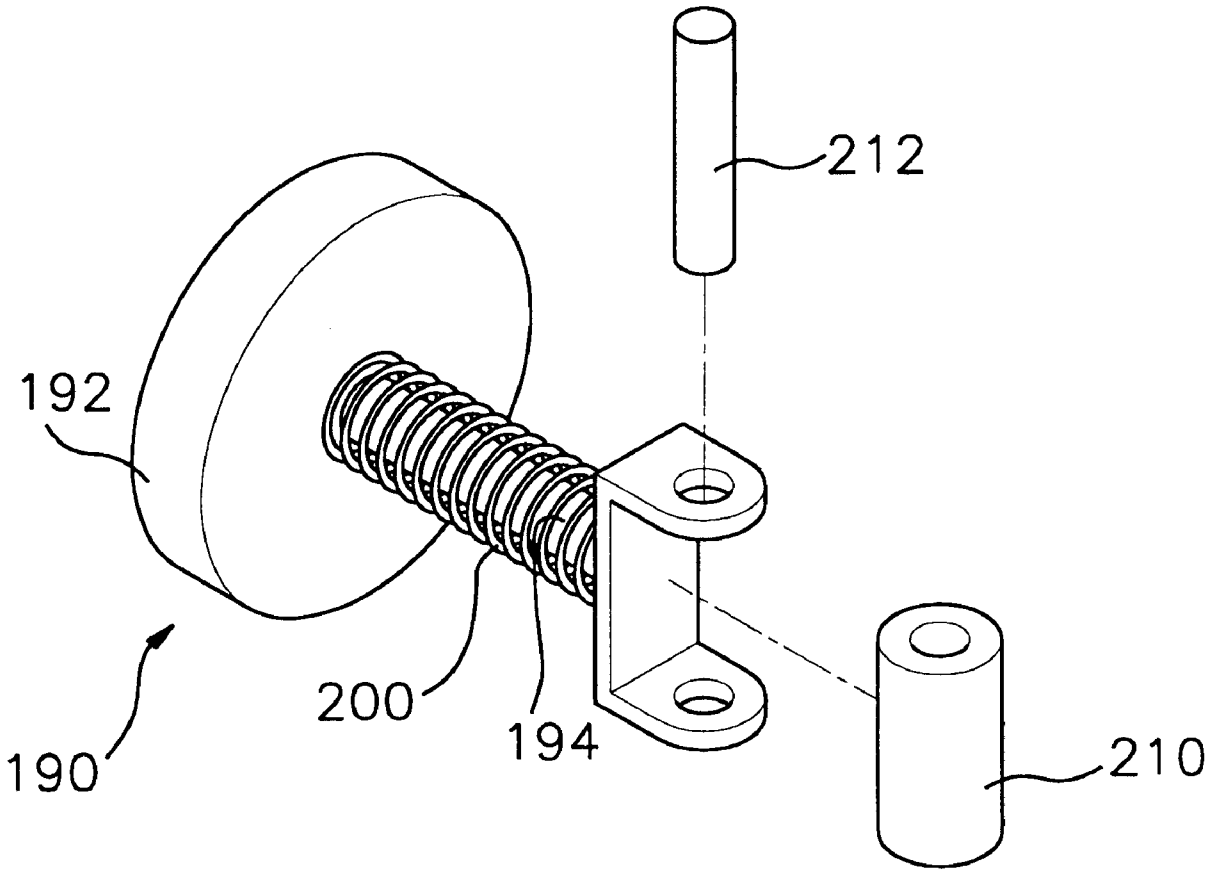
FIG. 3 is an enlarged exploded perspective view of a piston assembly utilized in FIG. 2.

As shown in FIG. 3, a piston assembly 190 is reciprocatingly arranged in the pumping chamber 180, and has a head 192 at one end of which a rod 194 is provided for moving through the opening 182. An elastic member 200 encircles the rod 194, thus enabling the rod 194 to remain in an initial position, that is, no compression force in the pumping chamber 180 occurs the piston assembly 190 when the cam 170 is contacted with the concave portion 174. It is preferable that the elastic member is shaped with a coil spring. A tappet roller 210 is provided at the end of the rod 194 proximal to the pulsator 160, and is rotatably arranged by a shaft 212. The tappet roller 210 is constantly in direct contact with the cam 170 by execution of the expanding coil spring 200.

Figure 4:
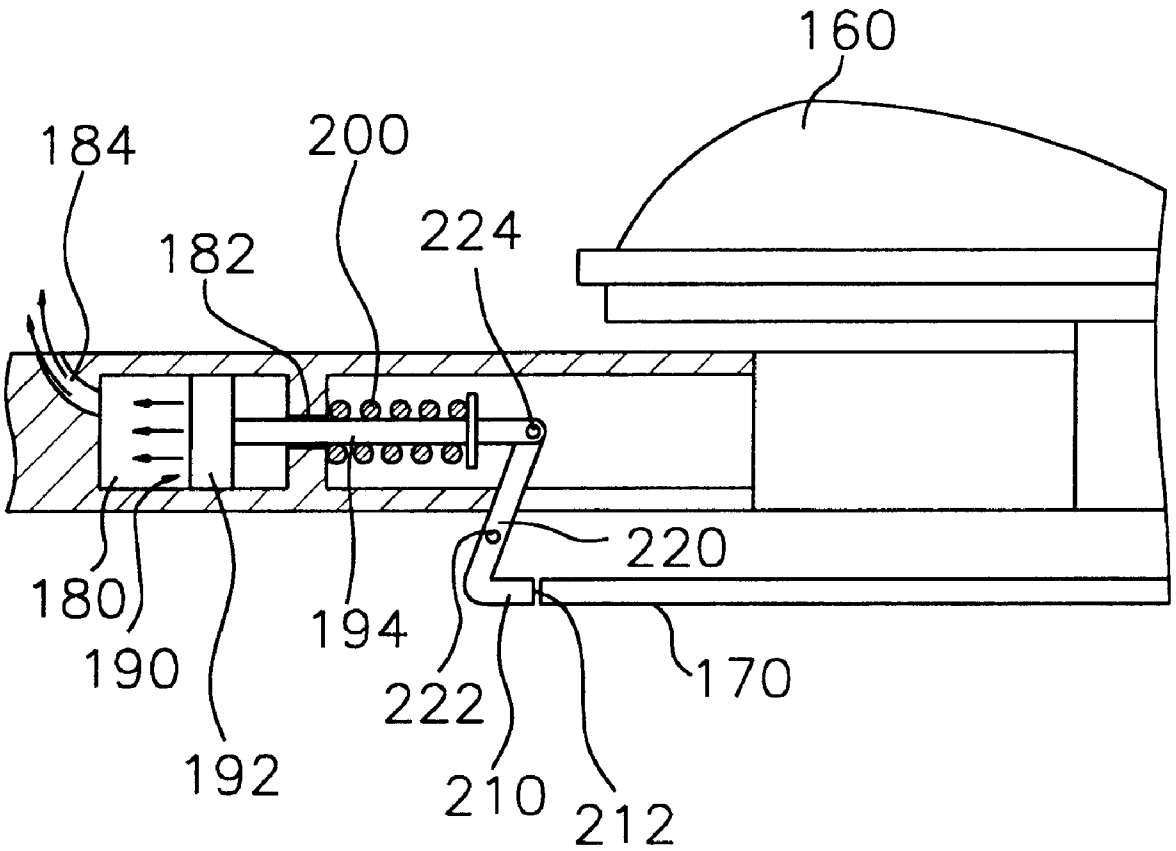
FIG. 4 is an enlarged cross sectional view of a rotational force apparatus as another embodiment according to the present invention.
Figure 5:
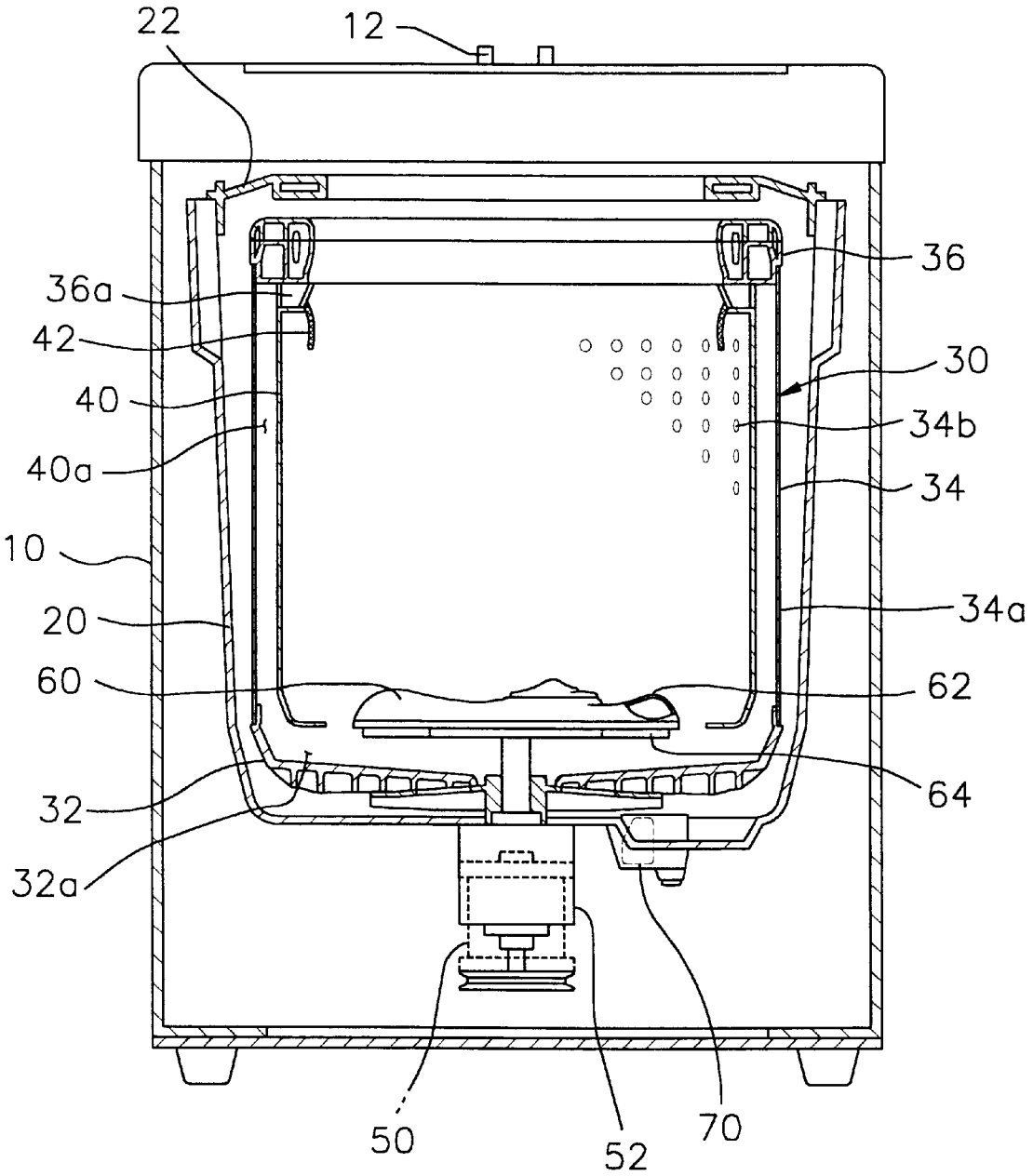
FIG.5 PRIOR ART
FIG. 5 is a vertical elevational view of the clothes washer according to a prior art.
Figure 6:
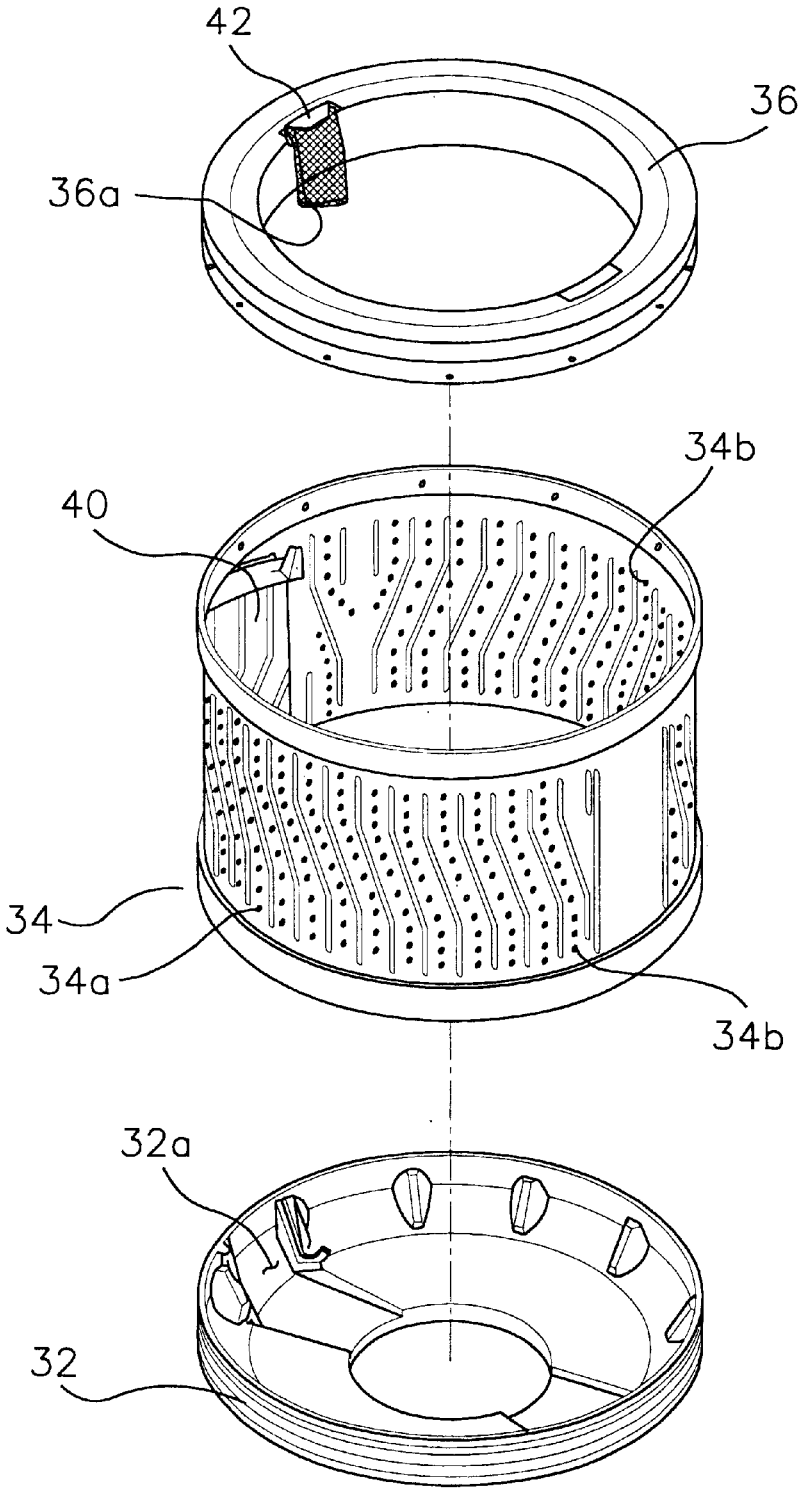
FIG.6 PRIOR ART
FIG. 6 is an exploded perspective view of a washing tub shown in FIG. 5.

Alternatively, as shown in FIG. 4, a lever 220 is provided between the cam 170 and the rod 194 of the piston assembly 190 for lengthening a reciprocated range of the piston assembly 190, which is hinged by a pin 222 which is fixed approximately at a middle portion of the lever 220. One end of the lever 220 proximal to the rod 194 is coupled with the rod 194 by engagement of the pin 224, and another end of the lever 220 distanced from the rod 194 has the rotatable tappet roller 210 being constantly indirect contact with the cam 170 by execution of the expanding coil spring 200. An elastic member, e.g., torsion spring, for springing back the lever 120 to the initial position is arranged at the shaft 222 of the lever 220 instead of the coil spring 200 which is mounted on the rod 194 of the piston assembly 190.

In the drawing, the pumping chamber 180 is horizontally arranged adjacent to the pulsator 160, but the pumping chamber 180 may be vertically positioned. In that case, periphery of the cam 170 is extended outward and upward to contact with the tappet roller 210 of the piston assembly 190. Furthermore, the opening 184 of the pumping chamber 180 can be extended near the water passage of the guide filter (not shown).

The clothes washer having the rotational force conversion apparatus according to the present invention constructed as above is operated as below.

The clothes are put in the washing tub 106 and a washing mode is selected. Then water via the supply valve 101 is supplied to the shower ring 118. The water in the shower ring 118 drops into the washing tub 106 through the inner periphery of the shower ring 118, which generates a shower water stream. The water in the washing tub 106 flows to the water basket 104 through a plurality of openings (not shown), and water is contained in the water basket 104.

As the motor 111 operates, the simultaneous operation of the gear mechanism 112 starts, thus causing the pulsator 160 to be rotated, and generating a cyclone water flow. The water is subjected to centrifugal force at the area under the pulsator 160, and is discharged through the spouting opening 162 above the pulsator 160, thereby enabling the water flow to spout. Bubbles generated by the bubble generator 115 are further supplied to the above occurrence, thereby continuing the washing mode.

The rotation of the driving shaft 114 is performed at the same time that the cam 170 is rotated and reciprocation of the piston assembly 190 is executed along the rotation of the cam 170. That is, during the rotation of the cam 170 the tappet roller 210 contacted with the concave portion 174 of the cam 170 initially is moved to the position of contacting with the convex portion 172 of the cam 170, thus advancing the piston assembly 190 toward the end of the pumping chamber 180 distal to the pulsator 160, i.e., the opening 184. Adversely, the condition of the tappet roller 210 contacting with the convex portion 172 changes to that contacting with the concave portion 174, thus retracting the piston assembly 190 to the initial position by execution of the elastic member 200, i.e., the coil spring or the torsion spring. The tappet roller 210 rotates around the shaft 212 in smooth contact with the cam 170, enabling the piston assembly 190 to smoothly reciprocate.

During the continuous reciprocation of the piston assembly 190, the water contained in the pumping chamber 180 is discharged through the opening 184 owing to the pumping process of the pumping chamber 180, thus generating a so-called strong spouting water flow. Clothes near the bottom of the washing tub 106 are raised toward the upper portion of the washing tub 106, and effectively struck by the spouting water flow.

In the case of FIG. 4, in which the additional lever 220 is provided between the rod 194 and the cam 170, since the lever 212 is hinged centering at the shaft 212 by rotation of the cam 170 and the piston 190 reciprocates along the hinged movement of the lever 212, the movement range of the piston assembly 190 lengthens relatively, causing a stronger spouting water flow than that illustrated in FIG. 1.

If the opening 184 of the pumping chamber 180 is located near the water passage of the guide filter (not shown), the volume of water supplied via the water passage 142 increases, thus causing the shower flow dropping from the shower ring 118 into the washing tub 106 to be more powerful. Even if the water contained in the washing tub 106 is in a lower level, the water disposed near the bottom portion of the washing tub 106 enters into an inlet opening (not shown) and is further supplied to the shower ring 118 via the guide filter (not shown), finally dropping into the washing tub and avoiding any reduction in washing efficiency.

According to the present invention as described above, since the pumping operation of the pumping chamber assists in the rotation of the pulsator while in the washing mode, water having strong pressure and washing force is concentrically supplied toward the bottom and the periphery of the clothes, thus accomplishing the washing rapidly and raising the washing efficiency.

While this invention has been particularly shown and described with reference to particular embodiments thereof, it will be understood by those skilled in the art that various changes in form and details may be effected therein without departing from the spirit and scope of the invention as defined by the appended claims.

What is claimed:

1. A clothes washer having a rotational conversion apparatus comprising:

a housing;

a water basket disposed in said housing for containing water;

a clothes basket disposed in said water basket and including a pulsator;

a driving mechanism for selectively driving said clothes basket and said pulsator;

a disk cam in which a shaft penetrates through a center of said disk cam, wherein said shaft is connected with said pulsator and extended perpendicular to said driving mechanism;

a plurality of followers contacting with said disk cam for converting a rotation of said disk cam into a reciprocating movement of a rod of a water compression apparatus; and said water compression apparatus provided according to the number of said followers, and each water compression apparatus having a pumping chamber including an opening for intaking or discharging water, a piston slidably disposed in said pumping chamber, a rod connecting said piston and said follower, and an elastic member for enabling said follower to be in constant contact with said disk cam.

2. The clothes washer having a rotational force conversion apparatus according to claim 1, wherein a lever is further provided between said rod and said cam in a hinged manner for lengthening a reciprocated range of said piston.

3. The clothes washer having a rotational force conversion apparatus according to claim 1, wherein said elastic member is a coil spring that encircles said rod.

4. The clothes washer having a rotational force conversion apparatus according to claim 1, wherein a tappet roller is rotatably provided at the contacting area between said rod and said cam.

* * * * *